United States Patent [19]

Hillström et al.

[11] Patent Number: 4,913,806

[45] Date of Patent: Apr. 3, 1990

[54] APPARATUS FOR SCREENING A SUSPENSION OF FIBROUS CELLULOSE PULP

[75] Inventors: Rune Hillström; Rolf Ekholm, both of Karlstad, Sweden

[73] Assignee: Kamyr AB, Karlstad, Sweden

[21] Appl. No.: 361,308

[22] Filed: Jun. 5, 1989

[30] Foreign Application Priority Data

Jul. 4, 1988 [SE] Sweden ..... 8802493

[51] Int. Cl.[4] ..... B07B 1/04

[52] U.S. Cl. ..... 209/273; 209/300; 210/413

[58] Field of Search ..... 209/268, 273, 300, 289, 209/290; 210/413, 414, 415; 162/55

[56] References Cited

U.S. PATENT DOCUMENTS

| | | | |
|---|---|---|---|
| 1,033,377 | 7/1912 | Bohn | 209/300 |
| 1,505,836 | 8/1924 | White | 209/273 |
| 4,680,108 | 7/1987 | Ahs | 209/273 |

FOREIGN PATENT DOCUMENTS

| | | | |
|---|---|---|---|
| 46568 | 7/1910 | Austria | 210/415 |
| 126821 | 10/1931 | Austria | 209/300 |
| 2028694 | 12/1971 | Fed. Rep. of Germany | 209/273 |

*Primary Examiner*—Donald T. Hajec
*Attorney, Agent, or Firm*—Nixon & Vanderhye

[57] ABSTRACT

An apparatus for screening a suspension of fibrous cellulose pulp is described which comprises a housing and a rotor shaft, the housing having an inject section, first and second screening sections, each of which comprising rotor members mounted on the rotor shaft and a cylindrical screening plate cooperating therewith and defining an outer accept chamber and an inner screening chamber, and a reject section for the removal of fiber suspension remaining at screening, the inject section communicating with the screening chamber of the first screening section. According to the invention the inject section is disposed between the first screening section and the second screening section, and the screening chamber of the first screening section communicates with the adjacent reject section. The housing includes an inlet section disposed at the end of the second screening section facing away from the inject section, so that an internal space of the inlet section communicates with the screening chamber of the second screening section, whereas the accept chamber of the first screening section communicates with the internal space of the inlet section via a communication extending outside the housing for transferring the fiber suspension screened off in the first screening section to the second screening section. Further, the screening chamber of the second screening section communicates with the adjacent inject section for circulation of the remaining fiber suspension passing axially through the screening chamber, the accept chamber of the second screening section having an outlet for discharging fiber suspension which has been screened off.

8 Claims, 1 Drawing Sheet

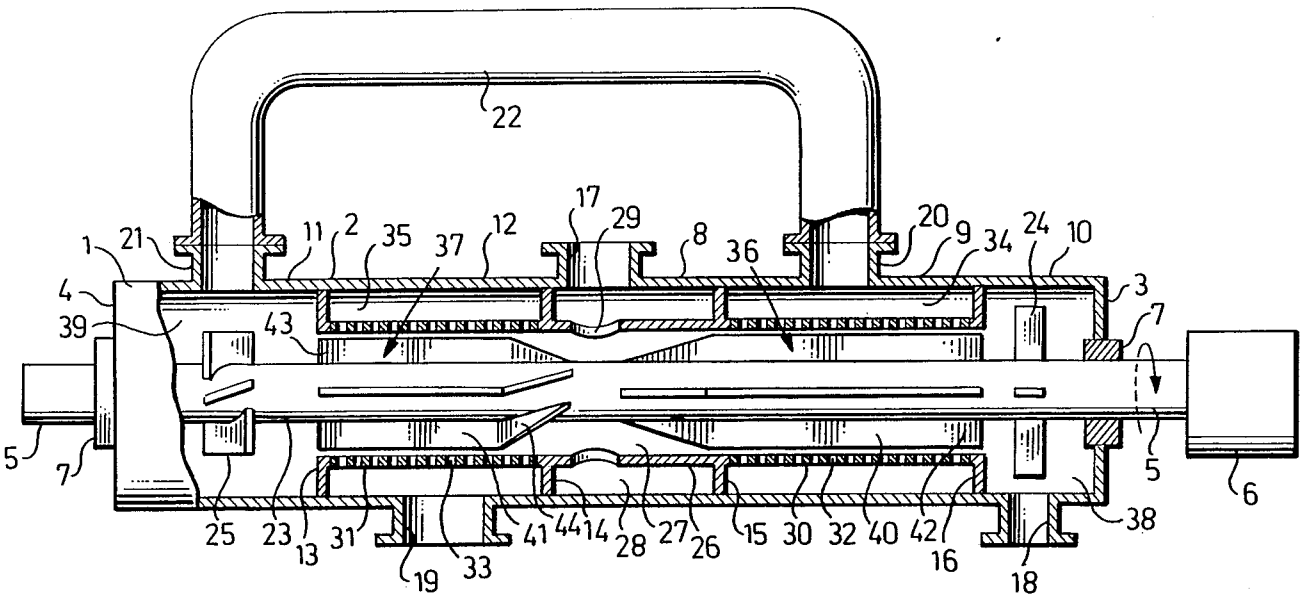
6
5
7
3
38
10
24
18
34
9
16
20
42
40
32
30
36
15
8
26
27
29
28
17
14
44
41
22
12
33
37
19
35
31
2
11
13
43
23
25
21
1
4
39
7
5

APPARATUS FOR SCREENING A SUSPENSION OF FIBROUS CELLULOSE PULP

FIELD AND BACKGROUND OF THE INVENTION

The present invention relates to an apparatus for screening a suspension of fibrous cellulose pulp, said apparatus comprising an elongate housing and a rotor shaft extending therethrough.

A screening apparatus for screening pulp is known through, for instance, U.S. Pat. No. 4,680,108. However, the screening apparatus disclosed therein includes two screening sections which are located close to each other and the intention is to screen off two different accepts from the screening apparatus.

In order to screen an accept from a screening apparatus one or more times further, a plurality of separate screening apparatuses have hitherto been used, disposed one after the other and driven individually. Such an installation is expensive, requires considerable space and the power consumption is high. Furthermore, the instrumentation required for flow-measurement is relatively extensive.

SUMMARY OF THE INVENTION

The object of the present invention is to provide a screening apparatus constituting a compact, i.e. space saving, unit containing at least two screening sections for screening an accept obtained from the immediately preceding screening section of the compact unit, the rotor members being driven by a common rotor shaft and thereby reducing the power consumption. The flow-measurement instrumentation will thus be simpler since it need only be provided for the reject and accept leaving the screening apparatus.

The present invention refers to an apparatus for screening a suspension of fibrous cellulose pulp, said apparatus comprising an elongate housing and a rotor shaft extending therethrough, said housing having an inject section, at least first and second screening sections, each of which comprising rotor members mounted on the rotor shaft and a cylindrical screening means cooperating therewith and defining an outer accept chamber and an inner screening chamber, and a reject section for the removal from the apparatus of fiber suspension remaining at screening, said inject section communicating with the screening chamber of the first screening section, said inject section being disposed between the first screening section and the second screening section, whereby the screening sections being disposed at a corresponding axial distance from each other, said screening chamber of the first screening section communicating with the adjacent reject section, said housing further including an inlet section disposed at the end of the second screening section facing away from the inject section, so that an internal space of the inlet section communicates with the screening chamber of the second screening section, said accept chamber of the first screening section communicating with the internal space of the inlet section via at least one communication extending outside the housing for transferring the fiber suspension screened off in the first screening section to the second screening section, and said screening chamber of the second screening section communicating with the adjacent inject section for circulation of the remaining fiber suspension passing axially through the screening chamber, the accept chamber of the second screening section having at least one outlet for discharging fiber suspension which has been screened off.

BRIEF DESCRIPTION OF THE DRAWING

A preferred embodiment of the invention will be described in the following, with reference to the accompanying drawing which shows schematically a screening apparatus according to the present invention, partially in longitudinal section.

DETAILED DESCRIPTION OF THE DRAWING

The drawing shows schematically a screening apparatus comprising an elongate housing 1 formed substantially by an outer cylindrical wall 2 and two end walls 3, 4. The screening apparatus includes an elongate horizontal rotor shaft 5, provided with rotor members and extending through the end walls 3, 4. The rotor shaft is provided at one end with a suitable drive device 6 to rotate the rotor shaft 5 in the direction indicated by an arrow. Suitable bearing and sealing units 7 are arranged on the rotor shaft 5 to seal against the end walls 3, 4. The screening apparatus is supported by. a stand having outer bearings (not shown) for the two end portions of the rotor shaft 5 located outside the housing 1.

Seen in the direction of flow of the fiber suspension, the elongate housing 1 is divided into an intermediate inject section 8, a first screening section 9, a reject section 10 located inside one end wall 3, an inlet section 11 located inside the other end wall 4, and a second screening section 12. All the sections 8 to 12 extend along the rotor shaft 5, surrounding said shaft, and are separated from each other by means of annular radial partition walls 13, 14, 15, 16 secured to the cylinder wall 2.

The housing 1 is provided with an inlet 17 connected to the inject section 8, for the fiber suspension which is to be screened, i.e. the inject, an outlet 18 connected to the reject section 10, for the remaining fraction of fiber suspension after screening, i.e. the reject, and an outlet 19 connected to the second screening section 12, for the finer fraction screened from the fiber suspension, i.e. the accept. The housing 1 is also provided with an outlet 20 connected to the first screening section 9, and an inlet 21 connected to the inlet section 11, said outlet 2O and inlet 21 communicating with each other by means of a pipe 22 for conveying the fiber suspension screened off in the first screening section 9 to the inlet section 11. This screened fiber suspension may be designated the first accept, whereas the accept leaving the screening apparatus through outlet 19 may be designated the second or final accept.

The rotor shaft 5 has a cylindrical body 23 which may have the same diameter along the whole screening apparatus, as shown in the drawing, or varying diameters in different sections if desired. Within the reject section 10 the rotor shaft 5 is provided with plurality of vanes 24, e.g. four vanes as shown, the vanes being designed to feed the reject radially out of the screening apparatus. Alternatively, a special impeller may be mounted on the rotor shaft 5. Within the inlet section 11 the rotor shaft 5 is provided with a plurality of vanes 25, e.g. four vanes as shown, which are designed to feed the screened fiber suspension (the first accept) entering through the inlet 21, axially forwards and into the second screening section 12.

The inject section 8 comprises an inner cylindrical partition wall 26 which is concentric with the rotor shaft 5. The partition wall 6 is attached to the two partition walls 14, 15 and defines an inner annular space 27 surrounding the rotor shaft 5 and an outer annular space 28, located immediately inside the cylinder wall 2, the partition wall 26 being provided with three circumferentially distributed inlet openings 29 for the inject.

Each screening section 9, 12 comprises a screening means 30, 31 consisting of a cylindrical screening plate disposed concentrically with the rotor shaft 5 and having suitable screening openings 32, 33 in the form of holes or slits, through which the finer fraction of the fiber suspension is separated as first accept and final accept, respectively. The screening plates 30, 31, which suitably have the same or substantially the same diameter as the cylindrical partition wall 26, are attached to the partition walls 15, 16 and 13, 14, respectively.

Each screening plate 30, 31 defines outwardly an annular accept chamber 34, 35, respectively, between itself and the outer cylinder wall 2, and inwardly an annular screening chamber 36, 37, respectively between itself and the rotor shaft 5. The accept chambers 34, 35 are thus axially defined by the opposite partition walls 15, 16 and 13, 14, respectively.

The screening chamber 36 of the first screening section 9 is axially in direct, i.e. open, communication upstream with the interior space 27 of the inject section 8 and downstream with a space 38 of the reject section 10. Similarly the screening chamber of the second screening section 12 is axially in direct, i.e. open, communication upstream with a space 39 of the inlet section and downstream with the interior space 27 of the inject section 8.

Each screening section 9, 12 also includes a rotor member 40, 41, respectively, comprising a plurality of protrusions 42, 43, respectively, attached to the cylindrical body 23 of the rotor shaft 5. The protrusions may be in the form of ribs, vanes or, as shown in the drawing, blades. Four blades 42, 43 are used in the embodiment shown, but the number may be varied depending on the capacity of the screening apparatus, the screening properties of the fiber suspension, etc. The blades 42, 43 extend along the cylindrical body 23 and radially outwards therefrom to the vicinity of each screening plate 30, 31 so that a suitably small space is formed between the free outer longitudinal edge of each blade 2, 43 and the inner side of the screening plate 30, 31 to ensure that the blades 42, 43 pass along the cylindrical screen faces of the screening plates 30, 31 without coming into contact therewith, during rotation of the rotor shaft 5. In the embodiment shown the blades 42, 43 extend axially along the rotor shaft 5 within the regions of the screening plates 30, 31. Alternatively, the blades may be suitably inclined, extending helically along the rotor shaft, in which case they should be directed to feed the fiber suspension in axial as well as radial direction. In the first screening section 9, the blades 42 may be extended a suitable distance into the inject section 8, as shown in -the drawing, and have therein a decreasing radial extension, starting from the first screening section 9.

Within the transition portion between the second screening section 12 and the inject section 8, the rotor shaft 5 is provided with blades 44 which are inclined in such a manner that they provide a feeding effect on the fiber suspension towards the first screening section 9. The blades 44 may consist of narrowing extensions of the rotor blades 43 of the second screening section 12, as shown in the drawing. Alternatively, they may have the same or substantially the same, and constant radial extension as the rotor blades 43. The inclined blades 44 help to feed the remaining fiber suspension, i.e. that passing axially through the second screening section 12, into the interior space 27 of the inject chamber, and then further into the first screening section 9. At the same time, the inclined blades 44 prevent inject from flowing backwards into the system, i.e. into the screening chamber 37 of the second screening section 12. The screening plate 31 may suitably be tight within the region of the inclined blades, as shown in the drawing. Alternatively, the blades 44 may extend a distance into the inject section 8. According to another alternative, they may extend from the end of the screening plate 31 and a suitable distance into the inject section 8.

The described screening apparatus is particularly suitable for screening pulp of medium concentration, i.e. about 6–15%. During operation the screening apparatus is completely filled with the fiber suspension which flows through the screening apparatus under pressure. The rotor shaft 5 is driven so that the rotor blades 42, 43 acquire a peripheral speed of about 20–25 m/sec. The rotor blades 42, 43 will thus pass along the cylindrical, inner screen faces of the screening plates at a sufficiently high speed so that the fiber suspension is subjected to shearing forces and pulsations, resulting in turbulences. The fiber suspension is by these effects converted to a fluidized state, i.e. an easy-flowing state, in which the fibers can move more easily in relation to each other.

The screening apparatus described constitutes a compact unit for double-screening, which has previously required two separate screening apparatuses, each with its own drive means. The fiber suspension supplied, i.e. the inject, flows through the inlet openings 29 in the partition wall 26 of the inject section 8, and further into the screening chamber 36 of the first screening section 9, where the rotor blades 42, cooperating with the screening plate 30, affect the fiber suspension so that the fiber suspension is fluidized at the same time as the fiber bundles are broken down. The reject from the first screening section 9 is fed through the reject outlet 18 to a device for special treatment, while the accept obtained is fed through the pipe 22 to the inlet section 11 and further into the second screening section 12 for a second, similar screening. The second or final accept is fed out through the accept outlet 19 for further treatment in the process line, while the reject from the second screening is mixed with fresh fiber suspension in the inject section 8.

That which is claimed is:

1. An apparatus for screening a suspension of fibrous cellulose pulp, said apparatus comprising an elongate housing and a rotor shaft extending therethrough, said housing having an inject section, at least first and second screening sections, each of which comprising rotor members mounted on the rotor shaft and a cylindrical screening means cooperating therewith and defining an outer accept chamber and an inner screening chamber, and a reject section for the removal from the apparatus of fiber suspension remaining at screening, said inject section communicating with the screening chamber of the first screening section, said inject section being disposed between the first screening section and the second screening section, whereby the screening sections being disposed at a corresponding axial distance from each other, said screening chamber of the first screening section communicating with the adjacent reject section, said housing further including an inlet section disposed at the end of the second screening section facing away from the inject section, so that an internal space of the inlet section communicates with the screening chamber of the second screening section, said accept chamber of the first screening section communicating with the internal space of the inlet section via at least one communication extending outside the housing for transferring the fiber suspension screened off in the first screening section to the second screening section, and said screening chamber of the second screening section communicating with the adjacent inject section for circulation of the remaining fiber suspension passing axially through the screening chamber, the accept chamber of the second screening section having at least one outlet for discharging fiber suspension which has been screened off.

2. An apparatus as claimed in claim 1 wherein the inject section comprises a cylindrical partition wall disposed concentrically with the rotor shaft and having openings for the fiber suspension.

3. An apparatus as claimed in claim 2 wherein the partition wall has substantially the same diameter as the screening means.

4. An apparatus as claimed in claim 1 wherein in the vicinity of the transition between the second screening section and the inject section, the rotor shaft is provided with inclined blades disposed to provide a feeding effect on the fiber suspension in the direction to the first screening section.

5. An apparatus as claimed in claim 1 wherein each rotor member comprises a plurality of blades or the like, extending along the rotor shaft and radially outwardly therefrom so that the outer, longitudinal edge of the blades is located close to the screen face of the screening mean without touching it.

6. An apparatus as claimed in claim 1 wherein said sections are separated from each other by means of radial, annular partition walls, on which the screening means and partition wall are secured.

7. An apparatus as claimed in claim 1 wherein the cellulose pulp being screened lies within the medium concentration interval.

8. An apparatus as claimed in claim 1 wherein it is mounted in a closed pressure system.

* * * * *